United States Patent [19]

Nishimoto et al.

[11] Patent Number: 5,061,321

[45] Date of Patent: Oct. 29, 1991

[54] PICKLING METHOD FOR ELECTRICAL STEEL BANDS

[75] Inventors: Akihiko Nishimoto; Yoshihiro Hosoya; Kunikazu Tomita; Toshiaki Urabe; Masaharu Jitsukawa, all of Tokyo, Japan

[73] Assignee: NKK Corporation, Tokyo, Japan

[21] Appl. No.: 425,179

[22] PCT Filed: Mar. 9, 1989

[86] PCT No.: PCT/JP89/00260

§ 371 Date: Oct. 12, 1989

§ 102(e) Date: Oct. 12, 1989

[87] PCT Pub. No.: WO89/08729

PCT Pub. Date: Sep. 21, 1989

[30] Foreign Application Priority Data

Mar. 10, 1988 [JP] Japan ..... 63-54771

[51] Int. Cl.[5] ..... C23G 1/02; C23G 1/08

[52] U.S. Cl. ..... 134/3; 134/9; 134/14; 134/15; 148/12 B; 148/12 E; 156/664

[58] Field of Search ..... 134/3, 64 R, 9, 14, 134/15; 148/12 B, 12 E; 156/664

[56] References Cited

U.S. PATENT DOCUMENTS

| | | | |
|---|---|---|---|
| 3,932,237 | 1/1976 | Irie et al. | 148/112 |
| 3,950,572 | 4/1976 | Ayusawa et al. | 148/12 R |
| 4,002,489 | 1/1977 | Hedqvist et al. | 134/41 |
| 4,144,379 | 3/1979 | Patil et al. | 148/12 C |
| 4,885,041 | 12/1989 | den Hartog et al. | 148/12 C |

FOREIGN PATENT DOCUMENTS

| | | |
|---|---|---|
| 54-76422 | 6/1979 | Japan . |
| 56-33436 | 4/1981 | Japan . |
| 60-138014 | 7/1985 | Japan . |

*Primary Examiner*—Anthony McFarlane
*Attorney, Agent, or Firm*—Nields & Lemack

[57] ABSTRACT

The present invention provides a pickling method for electrical steel bands having excellent surface properties without requiring any especial treatment and increasing costs, where the pickling conditions of the hot rolled steel band are optimized not only in view of de-scaling properties but also interglanular corrosions, and the pickling is performed with hydrochloric acid for a period of a specified time determined by Si content of steel, temperature and HCl concentration of a pickling liquid.

2 Claims, 4 Drawing Sheets

(I) $t = 7.12\,Si + 8.75$ (II) $t = 3.56\,Si + 59.35$ (III) $t = 0.0141 \exp(5300/RT)$ (IV) $t = 0.0389 \exp(5300/RT)$ R : Gas constant (=1.986 cal/mol·K)

(V) $t = 2825 / B$ (VI) $t = 7808 / B$ $B = -0.48 [HCℓ]^2 + 15.1 [HCℓ] + 5.03$

PICKLING METHOD FOR ELECTRICAL STEEL BANDS

TECHNICAL FIELD OF THE INVENTION

This invention relates to a pickling method for electrical steel bands.

BACKGROUND OF THE INVENTION

An electrical steel sheet is produced through processes of hot rolling a slab, annealing, if required, the hot rolled steel band for improving magnetic properties, pickling, cold rolling and finish annealing. It is known that this kind of steel is inferior in de-scaling properties during pickling, depending upon Si content as an essential element. There have been proposals for improving the de-scaling properties, e.g., in Japanese Patent Laid-Open Nos. 76,422/79, 33,436/81 or 138,014/85.

However with respect to the pickling of the hot rolled band, a big problem is involved about interglanular corrosions, irrespective of the de-scaling. If the electrical steel band is coiled at high temperatures after the hot rolling, the steel surface is effected with interglanular oxidation. If the pickling is continued unnecessarily after completion of the de-scaling, the corrosion grows as pitting in preference around the grain boundaries by the interglanular oxidation, and this fine cracks during a subsequent cold rolling, and deteriorates surface properties after the cold rolling. The fine cracks make various problems which not only degrade product values because of outer appearances of the products, but also deteriorate the magnetic properties, especially iron losses, by generating fine grains in the surface layers during finish annealing, and further cause of nonuniformity of insulation coatings.

Each of the above conventional proposals deals with the de-scaling only as the problem, and none of them specifies the pickling conditions by taking the intergranular corrosion into consideration.

DISCLOSURE OF THE INVENTION

In view of these foregoing problems, this invention optimizes the pickling conditions not only in the de-scaling properties but the intergranular corrosion in order to provide desired de-scaling properties and realize a pickling method enabling one to exactly check the interglanular corrosion.

For accomplishing the object, the invention is characterized by pickling, with hydrochloric acid, a hot rolled steel band containing Si: 0.2 to 4.0 wt % coiled at temperature of CT or annealed after coiling, satisfying following conditions: in a case of Si≦1.0 wt %

$$CT \geqq 270.6(\%Si)^2 - 475.9(\%Si) + 915.3$$

in a case of Si>1.0 wt %

$$CT \geqq 5.0(\%Si)^2 - 50.1(\%Si) + 7.55.4$$

herein,

CT: coiling temperature (° C.) of the hot rolled band (%Si): Si content (wt %); for period of pickling time satisfying a following condition $$0.48(\%Si) + 0.59 \leqq t.Bexp(-Q/RT) \leqq 0.24(\%Si) + 4.00$$

herein, (%Si): Si content (wt %) of the hot rolled band t: pickling time (sec)

T: temperature (K) of pickling liquid

B: $-0.48(HCl)^2 + 15.1(HCl) + 5.03$ wherein (HCl): HCl concentration (wt %) of pickling liquid Q: 5300 cal/mol R: 1.986 cal/mol.K

DETAILED DESCRIPTION OF THE INVENTION

The present invention will be explained in detail together with limiting reasons.

In the invention, the picklings are carried out on hot rolled silicon steel bands (including as-coiled ones and annealed ones after coiling) under specified conditions for avoiding the interglanular corrosions.

Through the inventors' experiments it was seen that the interglanular corrosion occurred in the hot rolled band having Si content and the coiling temperature in specified scopes. Therefore, in the invention, an object is limited to particular hot rolled steel bands which are determined with Si content and the coiling temperature.

Figure 1:
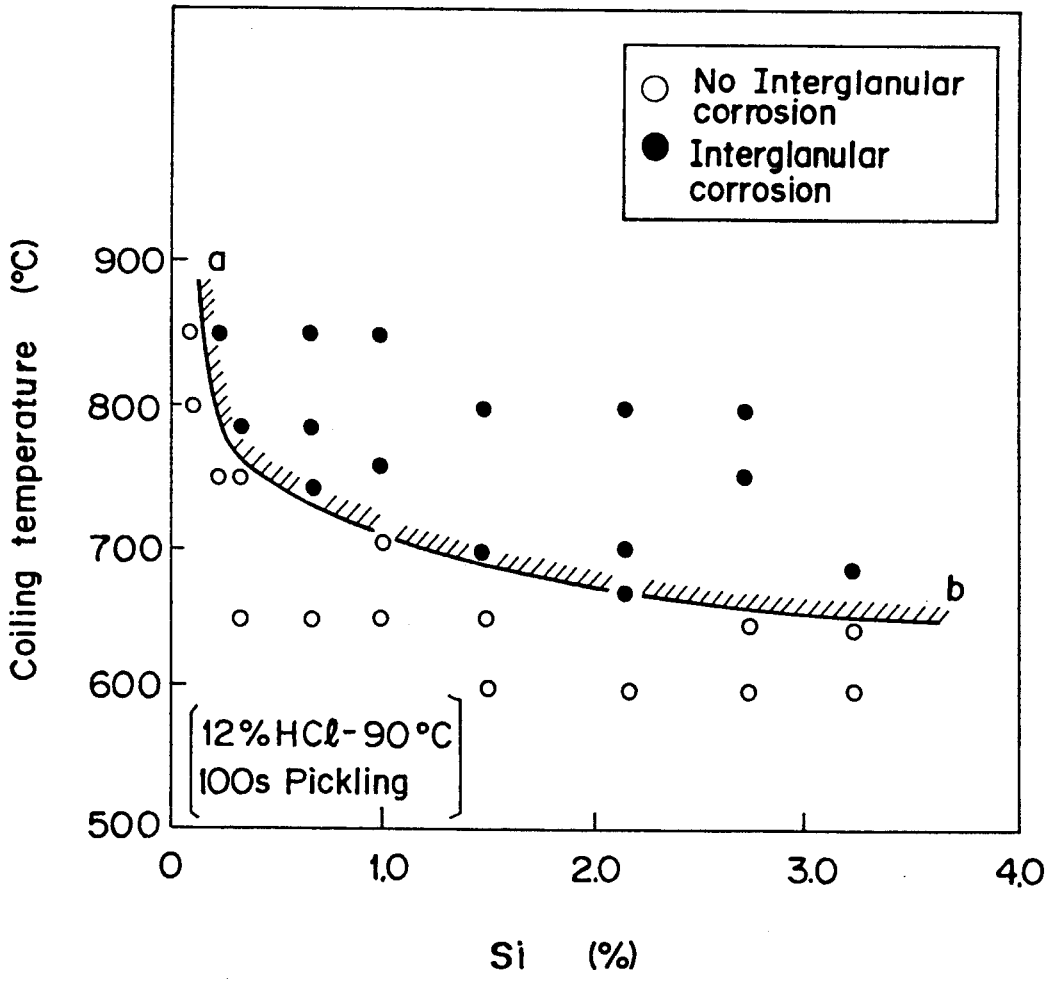
FIG. 1 shows the presence and absence of the interglanular corrosions in the hot rolled steel bands in relation between Si contents and coiling temperatures CT.

FIG. 1 shows, in relation between Si content and coiling temperatures CT, the presence and absence of the interglanular corrosions in Steel bands A to I of Table 1 hot rolled at various coiling temperatures and subjected to the picklings for a period of 100 sec under conditions of 12% HCl and 90° C., according to which the interglanular corrosions may be controlled by Si content and the coiling temperature, and they appear when the hot rolled bands of Si≧0.2 wt % are coiled at the temperatures above a - b in the figure. On the other hand, if the steel band of Si <0.2 wt % was coiled at the high temperature of 850° C., no interglanular corrosion appears, and if the steel of Si≧0.2 wt % was coiled less than a - b, no intergranular corrosion appears in spite of the heavy pickling using 12% HCl, 90° C. and 100 sec. The same results were obtained in the case of the hot rolled bands which were annealed under the various conditions after coiling.

The scope specified in FIG. 1 where the interglanular corrosion occurs is expressed in a case of Si≦1.0 wt %

$$CT \geqq 270.6(\%Si)^2 - 475.9(\%Si) + 915.3 \quad (1)$$

in a case of Si>1.0 wt %

$$CT \geqq 5.0(\%Si)^2 - 50.1(\%Si) + 755.4 \quad (2)$$

Therefore, the invention limits the object to the hot rolled steel bands containing Si≧0.2 wt % and satisfying the above formulas (1) and (2), and performs the pickling under the specified condition.

If Si content exceeds 4.0 wt %, the brittleness of the steel is marked, and since the cold rolling is difficult, the object is limited to the hot rolled steel bands of Si: 0.2 to 4.0 wt %.

In the invention, the pickling is carried out to satisfy the following formula of $$0.48(\%Si)+0.59 \leqq t.Bexp(-Q/RT) \leqq 0.24(\%Si)+4.00 \quad (3)$$

herein, (%Si): Si content (wt %) of the hot rolled band t: pickling time (sec)

T: temperature (K) of pickling liquid

B: $-0.48(HCl)^2+15.1(HCl)+5.03$ wherein (HCl): concentration (wt %) of HCl of pickling liquid Q: 5300 cal/mol R: 1.986 cal/mol.K.

The pickling condition has been specified as follows.

Figure 2:
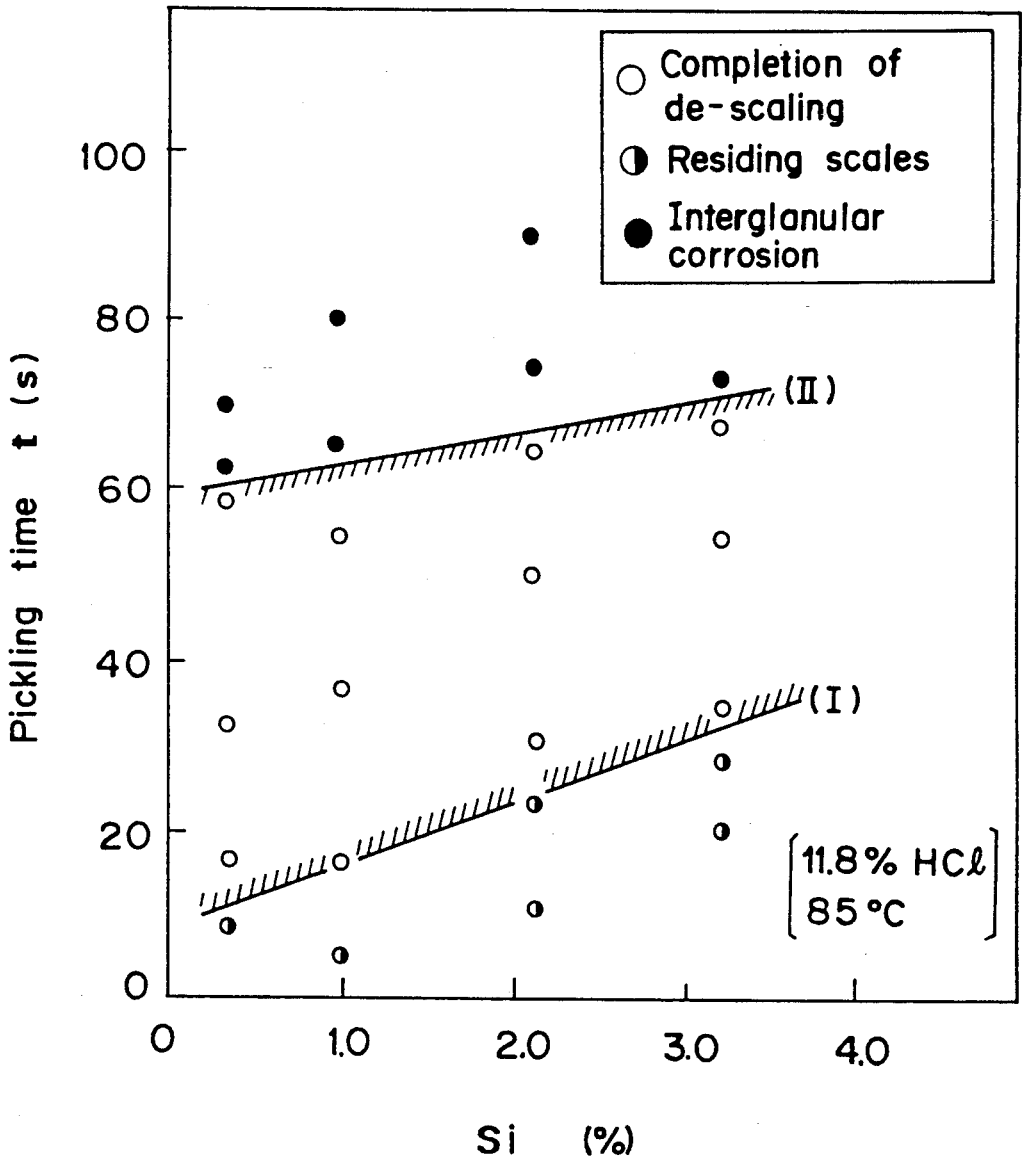
FIG. 2 shows the influences of Si content and the pickling time on the de-scaling properties and the interglanular corrosions.

FIG. 2 shows the influences of Si content and the pickling time on the de-scaling properties and the interglanular corrosion, where Steels C, E, G, I of Table 1 were hot rolled at the coiling temperature of 780° C., and pickled with the pickling liquid of 11.8% HCl and 85° C. in various times for studying the surface properties, according to which if the pickling time is short, the scales remain, and if it is long, the interglanular corrosions appear. A critical pickling time t with respect to completion of the de-scaling and occurrences of the interglanular corrosions is expressed with straight lines (I) and (II), that is, linear formulars (4) and (5) of Si contents $$t=7.12(\%Si)+8.75 \quad (4)$$

$$t=3.56(\%Si)+59.35 \quad (5)$$

Figure 3:
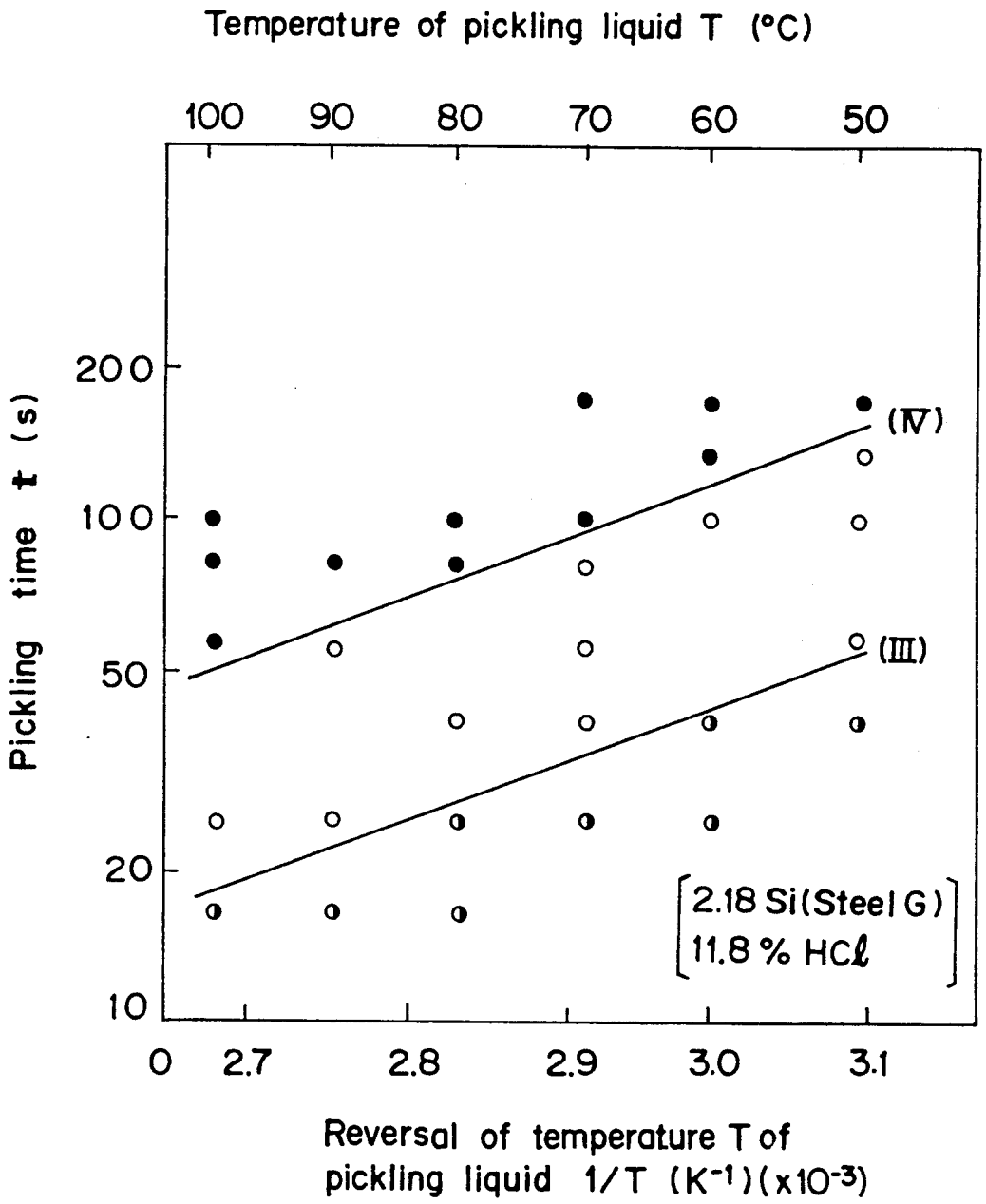
FIG. 3 shows the influences of the pickling temperature and the pickling time on the de-scaling properties and the interglanular corrosions.

FIG. 3 shows the influences of the pickling temperature and the pickling time on the de-scaling properties and the interglanular corrosion, where the hot rolled steel bands (CT=780° C.) of Steel G (Si: 2.18 wt %) of Table 1 were pickled under the constant concentration of 11.8% HCl at various temperatures for studying the surface properties, according to which the critical pickling time t with respect to completion of de-scaling and occurrences of the interglanular corrosions is expressed with following Arrhenius' equations (6) and (7)

$$t=0.0141\ exp(5300/RT) \quad (6)$$

$$t=0.0389\ exp(5300/RT) \quad (7)$$

Figure 4:
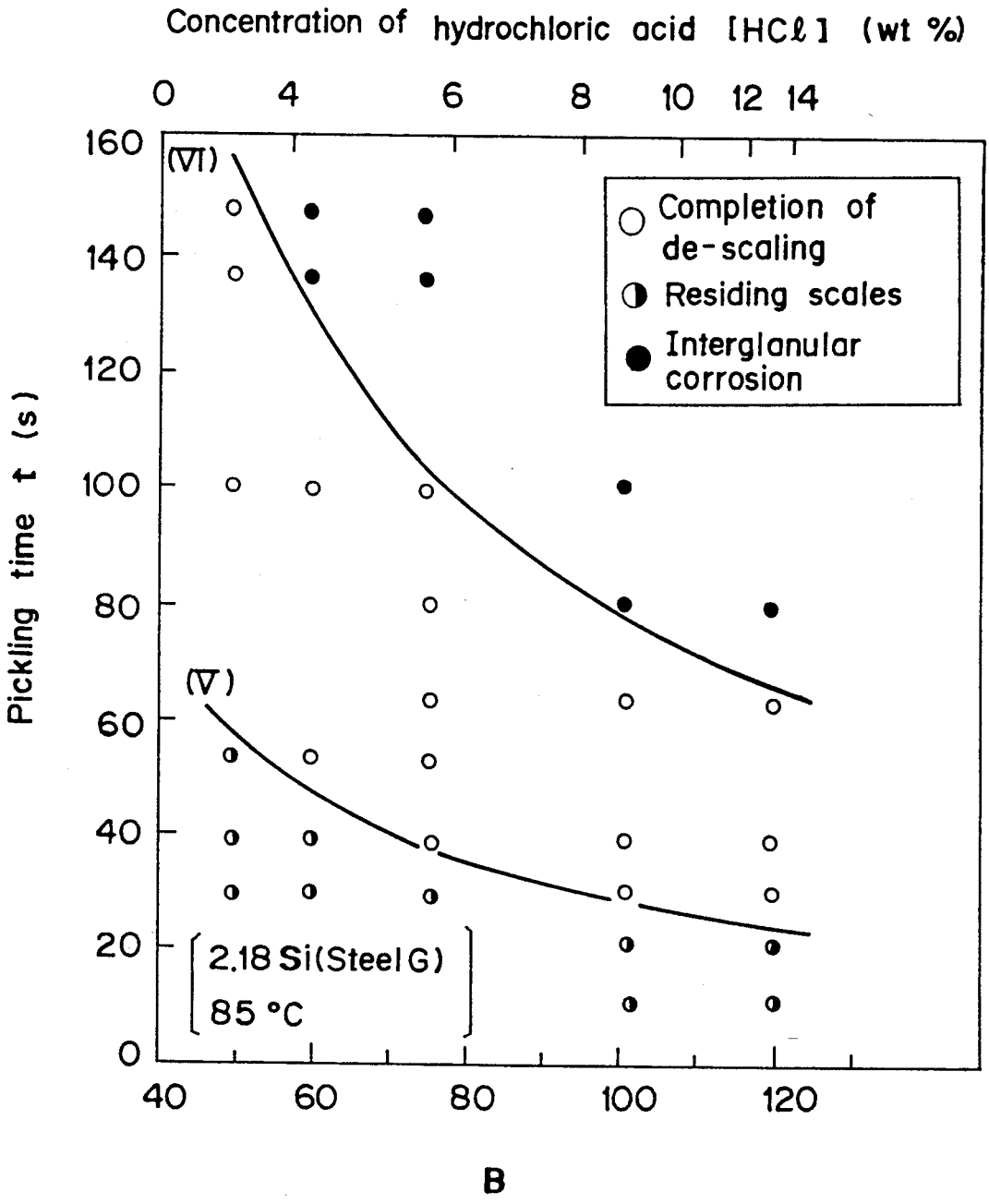
FIG. 4 shows the influences of HCl concentration of the pickling liquid and the pickling time on the de-scaling properties and the intergranular corrosion.

FIG. 4 shows the influences of HCl concentration of the pickling liquid and the pickling time on the de-scaling properties and the interglanular corrosion, where the hot rolled steel bands (CT=780° C.) of Steel G (Si: 2.18 wt %) of Table 1 were pickled with various HCl concentrations at the constant temperature of 85° C. for studying the surface properties, according to which the critical pickling time t with respect to completion of de-scaling and occurrence of the interglanular corrosion is expressed with following equations (8), (9), where B is as a parameter of HCl concentration $$t=2825/B \quad (8)$$

$$t=7808/B \quad (9)$$

herein, $B=-0.48(HCl)^2+15.1(HCl)+5.03$.

The same investigations as stated concerning FIG. 2 were made on the hot rolled bands of CT=730° C. (except Steel C) and CT=850° C., and the same results were obtained as in FIG. 2 and if the coiling temperature CT was above a - b in FIG. 1, the influences of the coiling temperature were not noted with respect to the critical pickling time.

The formula (3) mentioned above is obtained from the formulas (4) to (9) with respect to the optimum pickling time t where the de-sclaing is completed and the interglanular corrosion is not generated. That is, if the value of t.Bexp(−5300/RT) is less than 0.48(%Si)+0.59, the pickling would be insufficient and the scales remain, and if the value is more than 0.24(%Si)+4.00, the interglanular corrosion would be created.

Since an inhibitor has an effect of suppressing the interglanular corrosion in addition to an effect of suppressing corrosions of the matrix iron of the steel band, it may be added into the pickling liquid. In this case, the inhibitor should be added more than 0.2 wt % to the amount of HCl, otherwise satisfied effects could not be obtained, but if it is more than 1.0 wt %, the effect is saturated and the pickling speed is decreased.

According to the invention, it is possible to produce the electrical steel sheet having excellent surface properties with high economical effects by only optimizing the pickling time without requiring a special treatment and increasing cost. Besides, as the surface properties are excellent, any fine grains are not formed in the surface layers during the finish annealing, and therefore the products are excellent in the magnetic properties, especially the iron loss and are uniform in the isolation coating.

EXAMPLE

Slabs of Steels B, D, F, H of Table 1 were heated 1200° C., hot rolled to the thickness of 2.0 mm at the finish temperature of 930° C. The surface properties thereof were studied after picklings. Results (the de-scaling properties and presence and absence of the interglanular corrosion) are shown in Table 2 together with the pickling conditions.

According to the above mentioned, if the pickling time is within the scope specified in the invention, the de-scaling is completed, and no interglanular corrosion appears. On the other hand, if the pickling time is shorter than the invention scope, the scales remain, and if it is longer, the intreglanular corrosion appears.

TABLE 1

| Steels | C | Si | Mn | P | S | sol.Al | (wt %) N |
|---|---|---|---|---|---|---|---|
| A | 0.0079 | 0.11 | 0.34 | 0.019 | 0.009 | 0.004 | 0.0012 |
| B | 0.0067 | 0.23 | 0.31 | 0.025 | 0.004 | 0.002 | 0.0033 |
| C | 0.0041 | 0.33 | 0.29 | 0.105 | 0.003 | 0.001 | 0.0023 |
| D | 0.0049 | 0.67 | 0.37 | 0.094 | 0.004 | 0.253 | 0.0015 |
| E | 0.0050 | 1.00 | 0.24 | 0.040 | 0.006 | 0.228 | 0.0030 |
| F | 0.0022 | 1.52 | 0.18 | 0.009 | 0.003 | 0.365 | 0.0012 |
| G | 0.0026 | 2.18 | 0.26 | 0.018 | 0.003 | 0.321 | 0.0014 |
| H | 0.0032 | 2.74 | 0.23 | 0.007 | 0.002 | 0.274 | 0.0016 |
| I | 0.0030 | 3.25 | 0.30 | 0.005 | 0.001 | 0.898 | 0.0014 |

TABLE 2

| Steels | CT(°C.) | Pickling liquid | Optimum pickling time* | Pickling time | De-scaling | Intergranular corrosions | |
|---|---|---|---|---|---|---|---|
| B | 840 | HCl = 7 wt % 85° C. | 14–80s | 25s | ○ | ○ | Invention process |
| | | | | 10s | X | ○ | Comparison process |
| | | | | 100s | ○ | X | |
| D | 780 | HCl = 5 wt % 95° C. | 19–86s | 35s | ○ | ○ | Invention process |
| | | | | 15s | X | ○ | Comparison process |
| | | | | 100s | ○ | X | |
| F | 750 | HCl = 10 wt % 90° C. | 19–63s | 40s | ○ | ○ | Invention process |
| | | | | 15s | X | ○ | Comparison process |
| | | | | 80s | ○ | X | |
| H | 700 | HCl = 12 wt % 70° C. | 39–95s | 75s | ○ | ○ | Invention process |
| | | | | 25s | ○ | ○ | Comparison process |
| | | | | 120s | X | X | |

*Scope of pickling time of the invention

INDUSTRIAL APPLICABILITY

The present invention may be applied to the pickling treatment of the hot rolled steel bands in the production of the electrical steel sheets.

We claim:

1. A method of pickling electrical steel bands, comprising pickling, with hydrochloric acid, a hot rolled steel band containing 0.2 to 4.0 weight percent silicon by coiling at a temperature CT defined as follows:

where said silicon content is $\leqq 1.0$ wt %, $CT \geqq 270.6(\%Si)^2 - 475.9(\%Si) + 915.3$;

where said silicon content is $> 1.0$ wt %, $CT \geqq 5.0(\%Si)^2 - 50.1(\%Si) + 755.4$ where CT is coiling temperature (° C.) of the hot rolled band and (%Si) is the silicon content of said hot rolled band in weight percent, and pickling for a pickling time t defined as follows:

$$0.48(\%Si) + 0.59 \leqq t.B\exp(-Q/RT) \leqq 0.24(\%Si) + 4.00$$

where (%Si) is silicon content of said hot rolled steel band in weight percent; T is the temperature of the pickling liquid in °K; Q is 5300 cal/mole; R is 1.986 cal/(mole)(°K); t is time in seconds; and B is $-0.48(HCl)^2 + 15.1\ (HCl) + 5.03$ where (HCl) is the concentration of hydrochloric acid in the pickling liquid in weight percent.

2. A method according to claim 1 further comprising annealing said band after coiling.

* * * * *